US011108188B2

(12) United States Patent
Hashimoto

(10) Patent No.: US 11,108,188 B2
(45) Date of Patent: Aug. 31, 2021

(54) CONNECTOR

(71) Applicant: Sumitomo Wiring Systems, Ltd., Mie (JP)

(72) Inventor: Tsutomu Hashimoto, Mie (JP)

(73) Assignee: Sumitomo Wiring Systems, Ltd.

( * ) Notice: Subject to any disclaimer, the term of this patent is extended or adjusted under 35 U.S.C. 154(b) by 576 days.

(21) Appl. No.: 16/078,664

(22) PCT Filed: Feb. 3, 2017

(86) PCT No.: PCT/JP2017/003900
§ 371 (c)(1),
(2) Date: Aug. 22, 2018

(87) PCT Pub. No.: WO2017/145698
PCT Pub. Date: Aug. 31, 2017

(65) Prior Publication Data

US 2021/0194172 A1 Jun. 24, 2021

(30) Foreign Application Priority Data

Feb. 24, 2016 (JP) ..... JP2016-032987

(51) Int. Cl.
*H01R 13/506* (2006.01)
*H01R 13/52* (2006.01)

(52) U.S. Cl.
CPC ..... *H01R 13/506* (2013.01); *H01R 13/5208* (2013.01)

(58) Field of Classification Search
CPC ..... H01R 13/506; H01R 13/5219; H01R 13/5208
See application file for complete search history.

(56) References Cited

U.S. PATENT DOCUMENTS 6,280,237 B1 * 8/2001 Saka ..... H01R 13/4361 439/271
6,290,527 B1 * 9/2001 Takaya ..... G02B 6/3825 385/76

(Continued)

FOREIGN PATENT DOCUMENTS

| | | |
|---|---|---|
| JP | 2007-5012 | 1/2007 |
| JP | 2014-17085 | 1/2014 |
| JP | 2015-222665 | 12/2015 |

OTHER PUBLICATIONS

International Search Report dated Apr. 11, 2017.

*Primary Examiner* — Briggitte R. Hammond
(74) *Attorney, Agent, or Firm* — Gerald E. Hespos; Michael J. Porco; Matthew T. Hespos

(57) ABSTRACT

A connector 10 includes a first connector 11 including a first connector housing 20 provided with a receptacle 23 having an opening 23A on one end side and configured to accommodate a first terminal fitting 13 on a back end of the receptacle 23, and a second connector 15 to be connected to the first connector 11. The second connector 15 includes a second connector housing 40 to be accommodated into the receptacle 23, a second terminal fitting 17 to be accommodated into the second connector housing 20, connectable to the first terminal fitting 13 and having a wire W connected thereto, a rubber plug 60 configured to seal between an outer peripheral surface of the wire W and an inner peripheral surface of the receptacle 23 on a rear side of the second connector housing 20, and a holder 70 configured to retain the second connector housing 20 and the rubber plug 60 in the receptacle 23 by being engaged with an engaging projection 25 provided on an outer surface of the first connector housing 20 and mounted on the receptacle 23.

3 Claims, 15 Drawing Sheets

(56) References Cited

U.S. PATENT DOCUMENTS

| | | | | |
|---|---|---|---|---|
| 6,446,938 | B1 * | 9/2002 | Hadfield, Sr. | E06B 11/02 256/19 |
| 9,065,198 | B2 * | 6/2015 | Uchida | H01R 13/5219 |
| 2007/0004247 | A1 | 1/2007 | McClelland | |
| 2014/0011383 | A1 | 1/2014 | Uchida | |

* cited by examiner

CONNECTOR

BACKGROUND

Field of the Invention

The present invention relates to a connector.

Related Art

Japanese Unexamined Patent Publication No. 2014-17085 discloses a connector that may be used in an environment where foreign matters such as metal powder and metal pieces float in lubricant stored in a case. In this connector, both male and female housings are held in a connected state by locking a lock arm provided on the female housing into a lock hole provided in a receptacle of the male housing. The lock hole is provided in the receptacle of this connector. Thus, foreign matter may intrude into the receptacle through the lock hole to short terminal fittings. Accordingly, this connector has a convex-concave shape provided on a connection surface for preventing the intrusion of foreign matter and to prevent a short circuit between the terminal fittings.

The connector described in Japanese Unexamined Patent Publication No. 2014-17085 is structured such that a short circuit caused by foreign matter is prevented by using the convex-concave shape to extend a creepage distance between the terminal fittings. However, the intrusion of the foreign matter itself cannot be prevented. Thus, there is room left for improvement.

It is thought to make a connector watertight (liquid-tight) to prevent the intrusion of such foreign matter. In a general waterproof connector, sealing is provided between both male and female housings by overlapping a receptacle of the female housing on a receptacle of the male housing and disposing waterproof rubber between these receptacles. However, in such a waterproof connector, the connector housings are enlarged in a width direction (radial direction) to overlap the receptacles and dispose the waterproof rubber between the receptacles.

SUMMARY

A connector disclosed in this specification is a connector with a first connector including a first connector housing provided with a receptacle having an opening on one end and configured to accommodate a first terminal fitting on a back end of the receptacle, and a second connector to be connected to the first connector. The second connector includes a second connector housing to be accommodated into the receptacle. A second terminal fitting is to be accommodated into the second connector housing, and is connectable to the first terminal fitting and having a wire connected thereto. A rubber plug is configured to seal between an outer peripheral surface of the wire and an inner peripheral surface of the receptacle on a rear end of the second connector housing. A holder is configured to retain the second connector housing and the rubber plug in the receptacle by being engaged with an engaging projection provided on an outer surface of the first connector housing and mounted on the receptacle.

According to this configuration, the second connector housing is accommodated into the receptacle of the first connector housing, the rear end of the second connector housing is sealed by the rubber plug and the second connector housing and the rubber plug are retained by the holder. Thus, the intrusion of foreign matters into the second connector housing in the receptacle is prevented by the rubber plug, wherefore a short circuit between the terminals can be prevented. Further, since the holder is mounted on the receptacle by engaging the holder with the engaging projection provided on the outer surface of the first connector housing, no locking hole is provided in the receptacle of the first connector housing and sealing by the rubber plug is ensured. Furthermore, no receptacle is overlapped on the receptacle (unlike general waterproof connectors). Thus, enlargement in a width direction (radial direction) can be suppressed.

The holder may be provided with a projecting portion projecting toward the second connector housing. The rubber plug may be provided with an insertion hole enabling the insertion of the projecting portion, and the second connector housing may be provided with an engaging portion engageable with an engaging claw provided on a tip part of the projecting portion. In this configuration, the projecting portion can be inserted into the insertion hole and the engaging claw thereof can be engaged with the engaging portion of the second connector housing. Thus, the second connector can be connected to the first connector with the second connector housing, the rubber plug and the holder of the second connector assembled in advance. Accordingly, an assembly operation is easier as compared to the case where these components are arranged separately in the receptacle.

The first connector housing may include a cylindrical fitting to be fit into a mounting hole provided in a device. The receptacle may be insertable into the mounting hole and have an oval cross-sectional shape. The engaging projection may project in a minor axis direction of the receptacle, and the holder of the second connector may be provided with a lock arm having an engaging hole engageable with the engaging projection. In this configuration, the fitting is fit into the mounting hole of a case after the receptacle is inserted into the mounting hole. Thus, if outer dimensions of the receptacle become smaller, outer dimensions of the fitting can be made smaller and the mounting hole can be reduced in size. Further, the engaging projection projects in the minor axis direction of the receptacle and the lock arm is overlapped on the receptacle to be engaged with the engaging projection. Accordingly, maximum outer dimensions of the entire receptacle can be made smaller. That is, dimensions of the fitting portion and the mounting hole can also be made smaller.

According to the connector disclosed in this specification, it is possible to suppress the intrusion of foreign matters to a connection surface.

DETAILED DESCRIPTION

Figure 1:
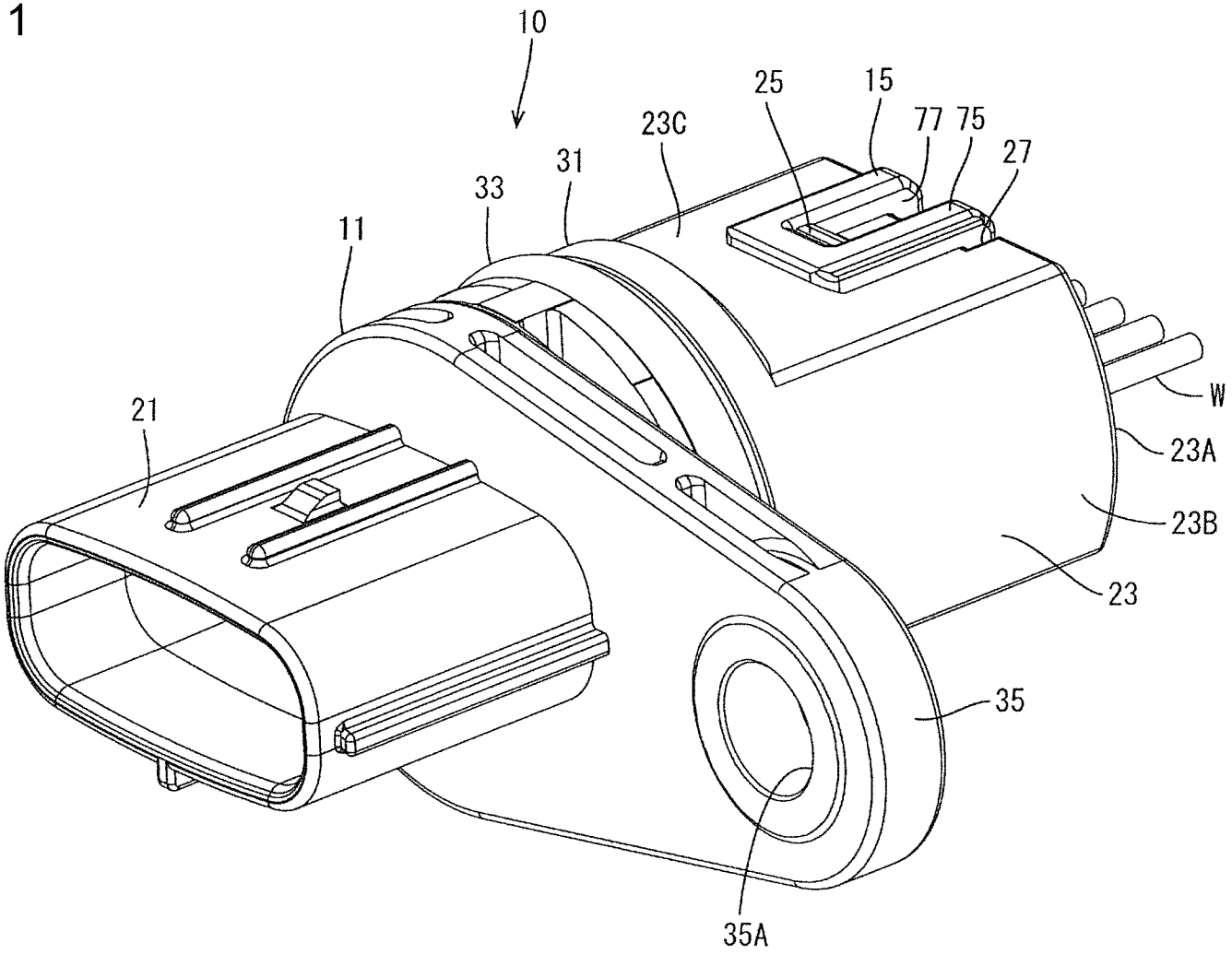
FIG. 1 is a perspective view of a connector in an embodiment.
Figure 2:
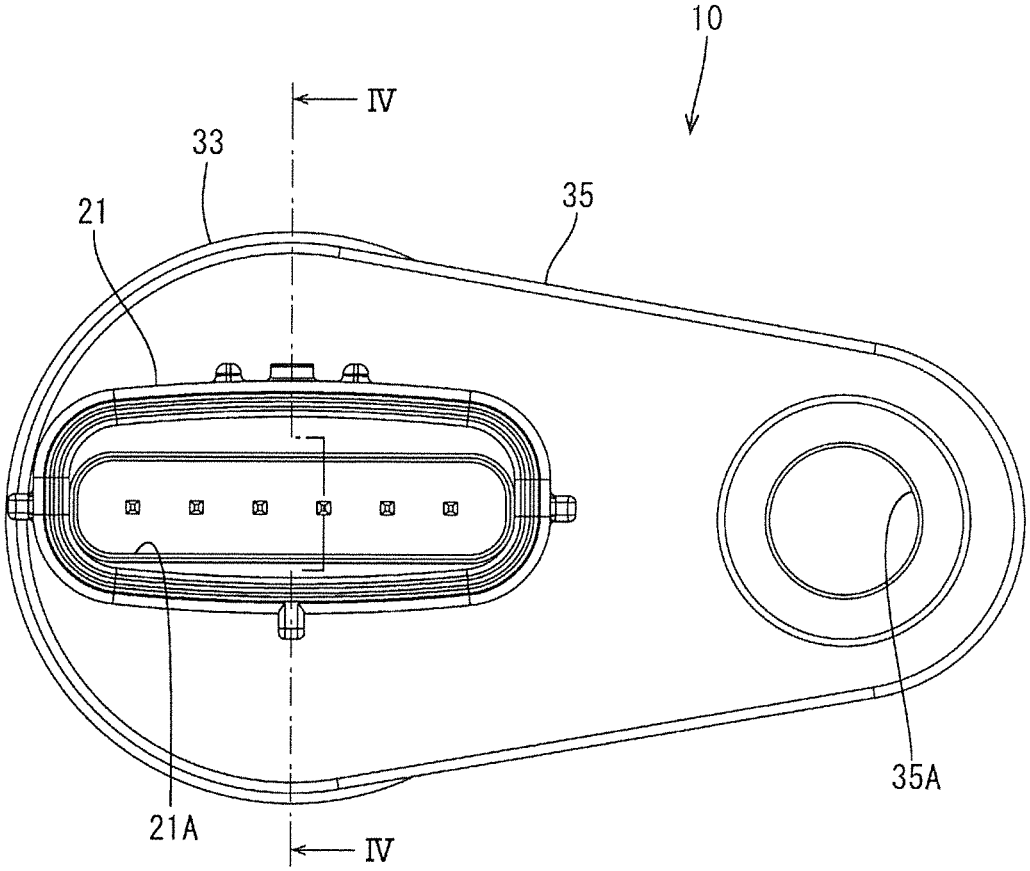
FIG. 2 is a front view of the connector.
Figure 3:
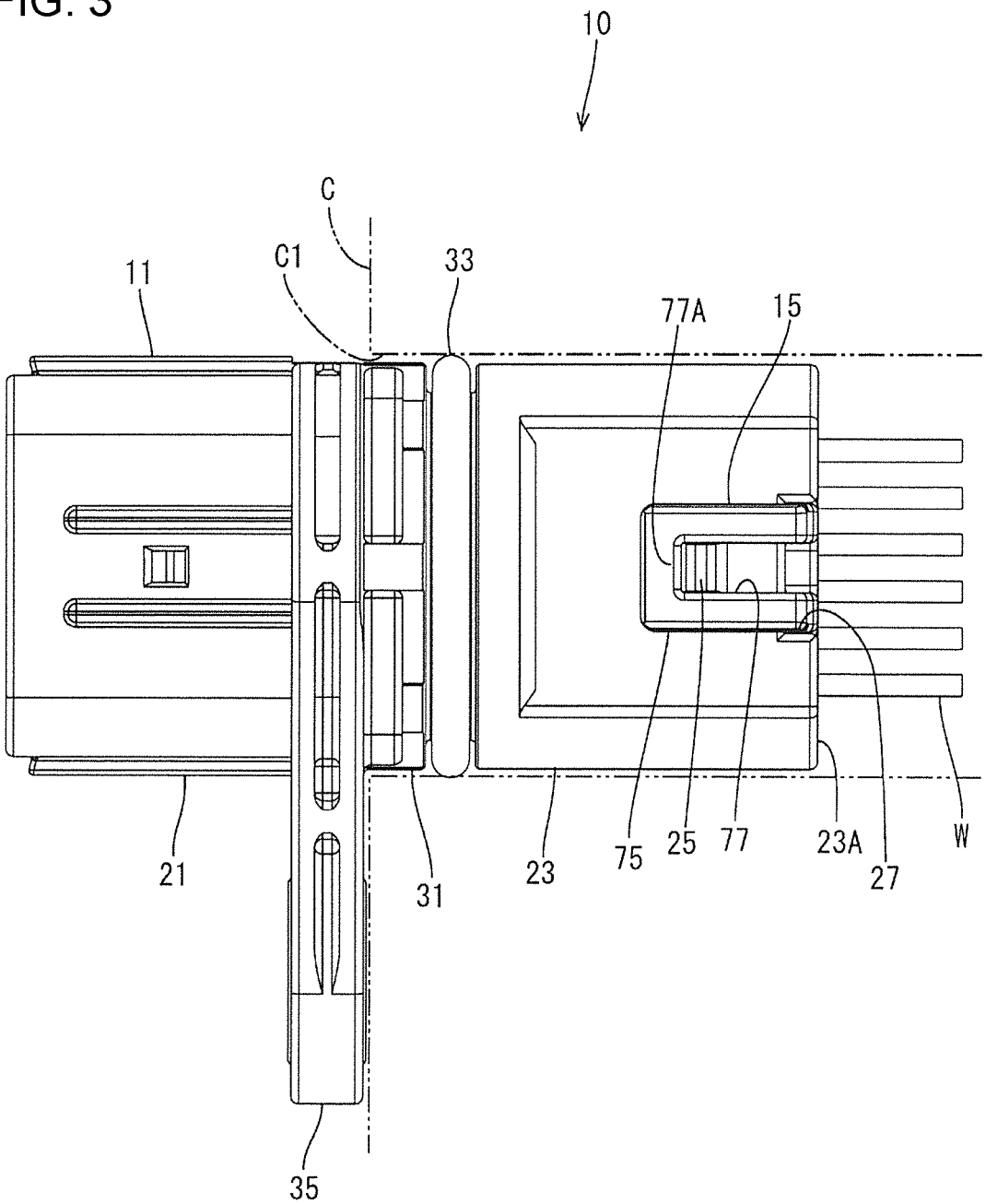
FIG. 3 is a plan view of the connector.

An embodiment is described with reference to FIGS. 1 to 18. As shown in FIGS. 1 and 3, a connector 10 of this embodiment includes a relay connector 11 (an example of a "first connector") to be fixed to a case C of a device such as an automatic transmission of a vehicle and a female connector 15 (an example of a "second connector") to be connected to one end of the relay connector 11. When the relay connector 11 is fit into a round mounting hole C1 of the case C, a side of the relay connector 11 to which the female connector 15 is to be connected is disposed in lubricant in which foreign matters such as iron powder float, and the other end side is disposed outside the case C. Note that, in the following description, a left side of FIG. 3 (connecting direction of the female connector 15) is referred to as a front side and a right side of FIG. 3 is referred to as a rear side concerning a front-rear direction. Further, a vertical direction is based on FIG. 2, wherein upper and lower sides of FIG. 2 are referred to as upper and lower sides.

Figure 4:
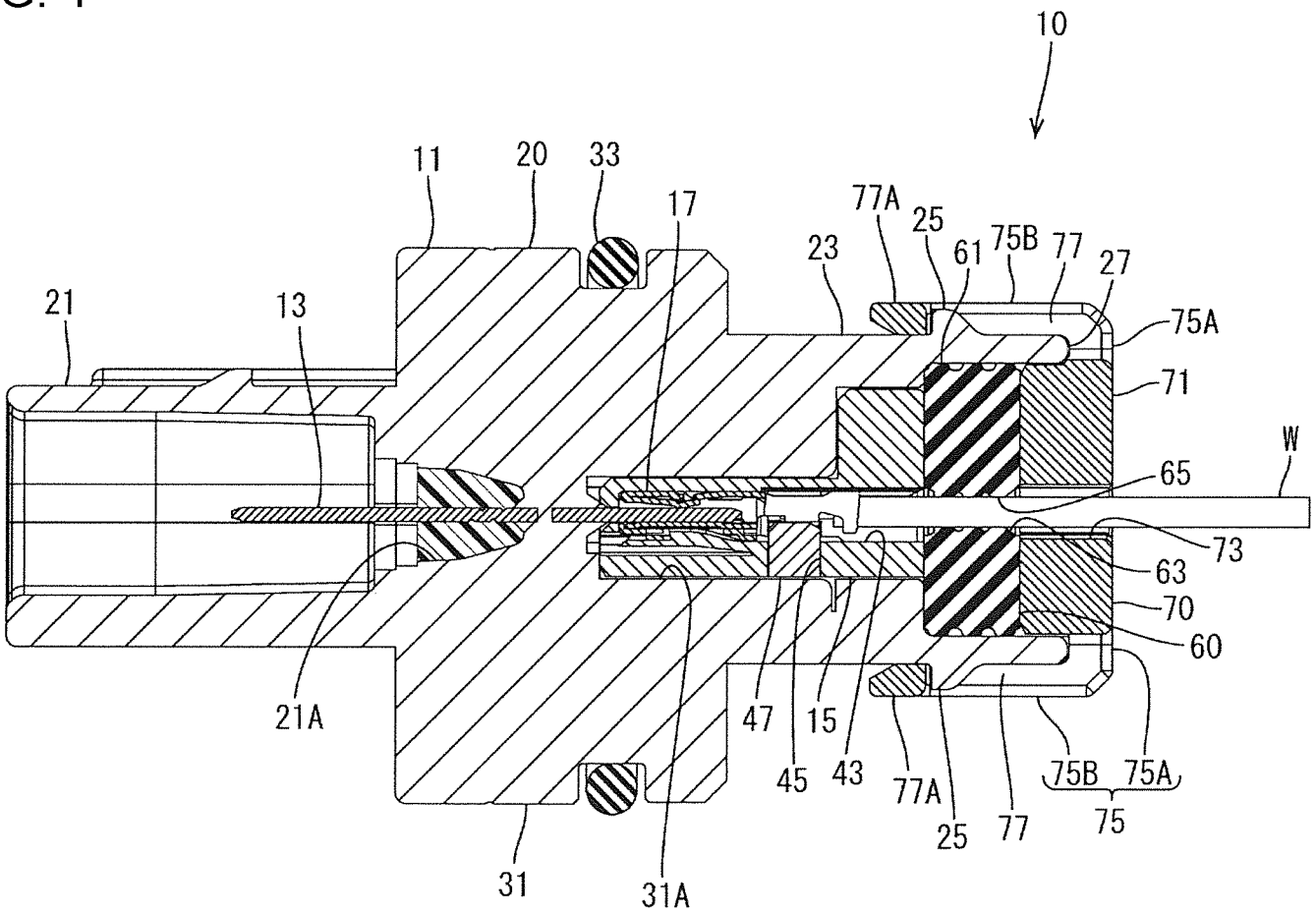
FIG. 4 is a section at position Iv-Iv in FIG. 2.

As shown in FIGS. 3 and 4, the relay connector 11 includes relay terminal fittings 13 (an example of a "first terminal fitting") and a relay connector housing 20 (an example of a "first connector housing"). The relay terminal fitting 13 is a busbar in the form of a rectangular column, a central part is embedded in the relay connector housing 20 by insert molding, whereas both end parts project into receptacles 21, 23 of the relay connector housing 20 to be described later.

The relay connector housing 20 is made of synthetic resin and shaped to be open forward and rearward as shown in FIGS. 3 and 4. The relay connector housing 20 includes the outer receptacle 21 disposed outside the case C, the inner receptacle 23 (an example of a "receptacle") disposed inside the case C, and a fitting portion 31 located between the both receptacles 21 and 23 and to be fit into the mounting hole C1 of the case C.

As shown in FIGS. 1 and 3, the fitting portion 31 has a cylindrical shape and a rubber ring 33 for sealing between the fitting portion 31 and the mounting hole C1 when the fitting portion 31 is fit into the mounting hole C1 of the case C is mounted on the outer peripheral surface of the fitting portion 31. Further, a mounting piece 35 laterally protruding from the fitting portion 31 is provided on a rear end part of the fitting portion 31. The mounting piece 35 is provided with a bolt insertion hole 35A penetrating in the front-rear direction, and the relay connector housing 20 is fixed to the case C by inserting a bolt into this bolt insertion hole 35A and tightening the bolt into the case C.

As shown in FIGS. 2 and 4, the outer receptacle 21 is open forward and the relay terminal fittings 13 project forward from a back end surface of the outer receptacle 21. Further, a recess 21A is provided from a back end part of the outer receptacle 21 to the fitting portion 31. A potting agent is poured into this recess 21A and solidified, whereby it is suppressed that oil comes out to the outside of the case C along the relay terminal fittings 13.

As shown in FIGS. 1 and 4, the inner receptacle 23 includes an opening 23A open rearward. A recess of the inner receptacle 23, into which the female connector 15 is to be fit, extends to the fitting portion 31, and the fitting portion 31 is provided with a fitting recess 31A communicating with the inner receptacle 23. The shapes of the inner peripheral surface of the inner receptacle 23 and the fitting recess 31 of the fitting portion 31 conform to the shape of the outer peripheral surface of the female connector 15, and constitute a stepped shape having a smallest vertical dimension on a back side (front side). The relay terminal fittings 13 project rearward from the back end surface (front end surface) of the inner receptacle 23

Further, the outer shape of the inner receptacle 23 has an oval cross-sectional shape (back view), and the vertical direction serves as a minor axis direction along which the inner receptacle 23 is shorter than along a width direction. Both side surfaces 23B of the inner receptacle 23 are curved surfaces and flush with the shape of the outer surface of the fitting portion 31. Further, upper and lower surfaces 23C of the inner receptacle 23 are flat surfaces. An engaging projection 25 projecting in the vertical direction is provided on each of the upper and lower surfaces 23C of the inner receptacle 23. Further, cut portions 27 cut to be recessed forward are provided in rear end parts of the upper and lower surfaces 23C of the inner receptacle 23.

Figure 5:
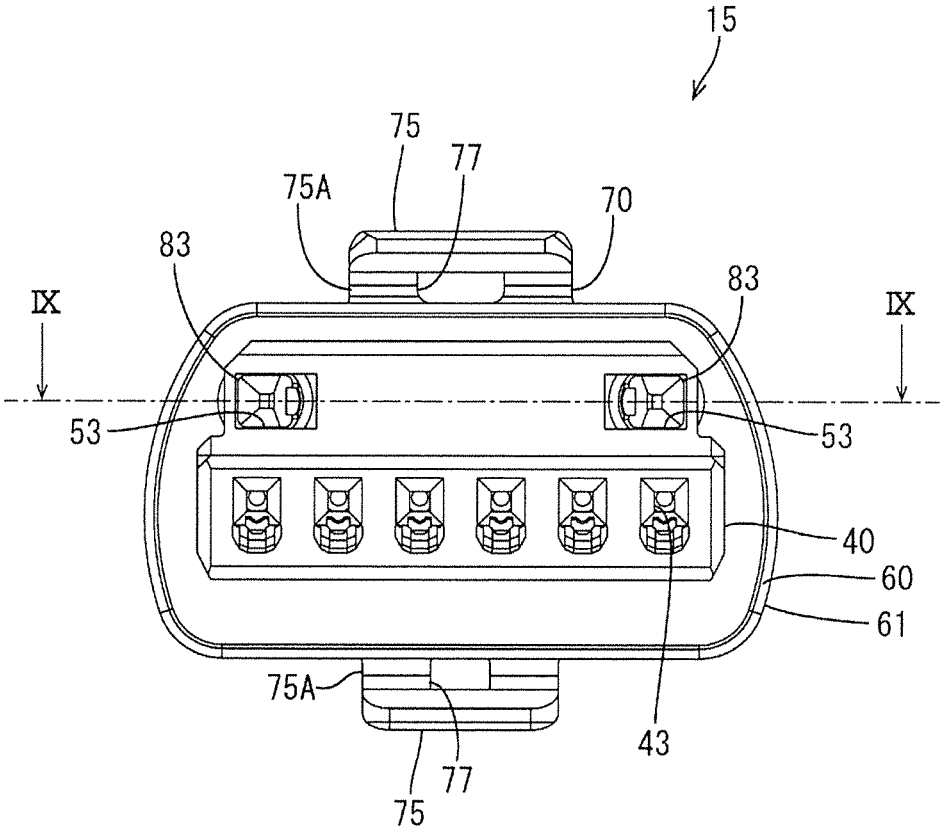
FIG. 5 is a front view of a female connector.
Figure 6:
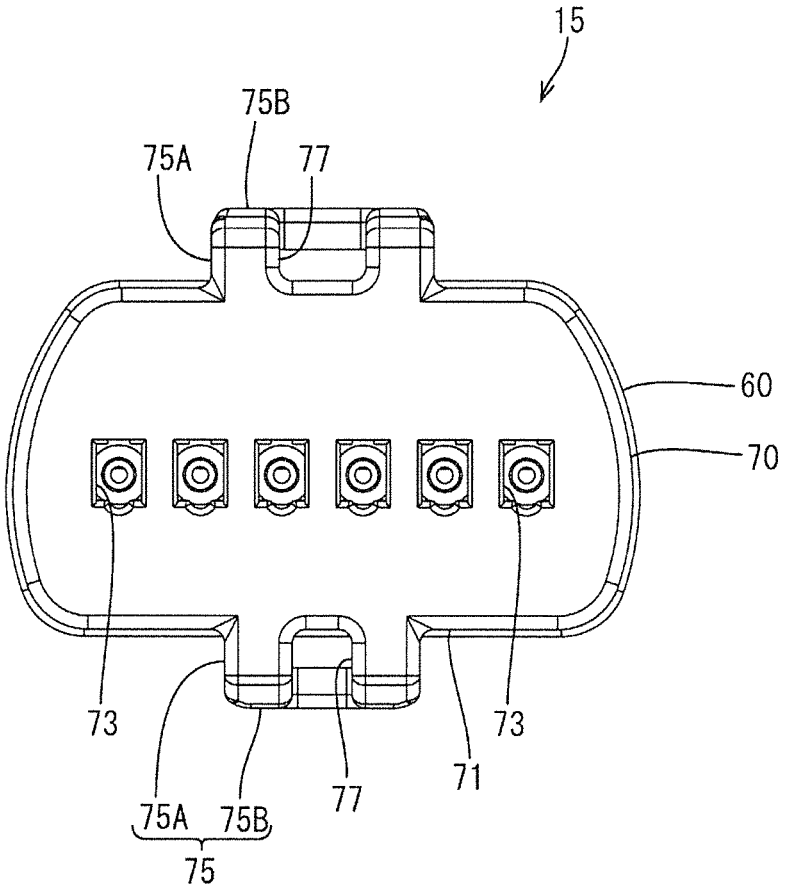
FIG. 6 is a back view of the female connector.
Figure 7:
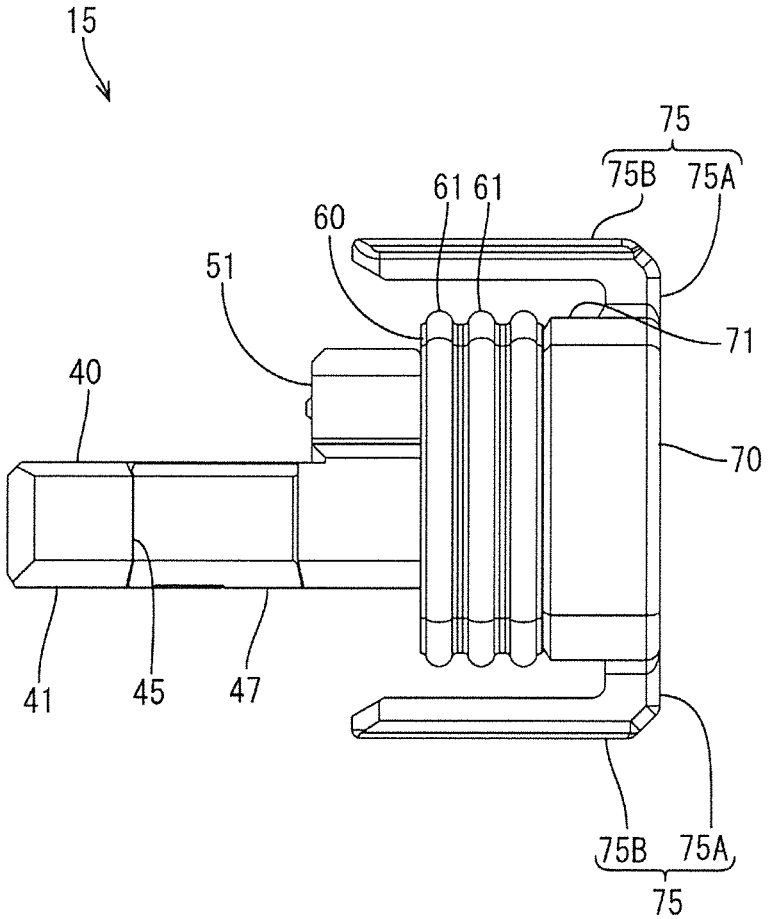
FIG. 7 is a side view of the female connector.
Figure 8:
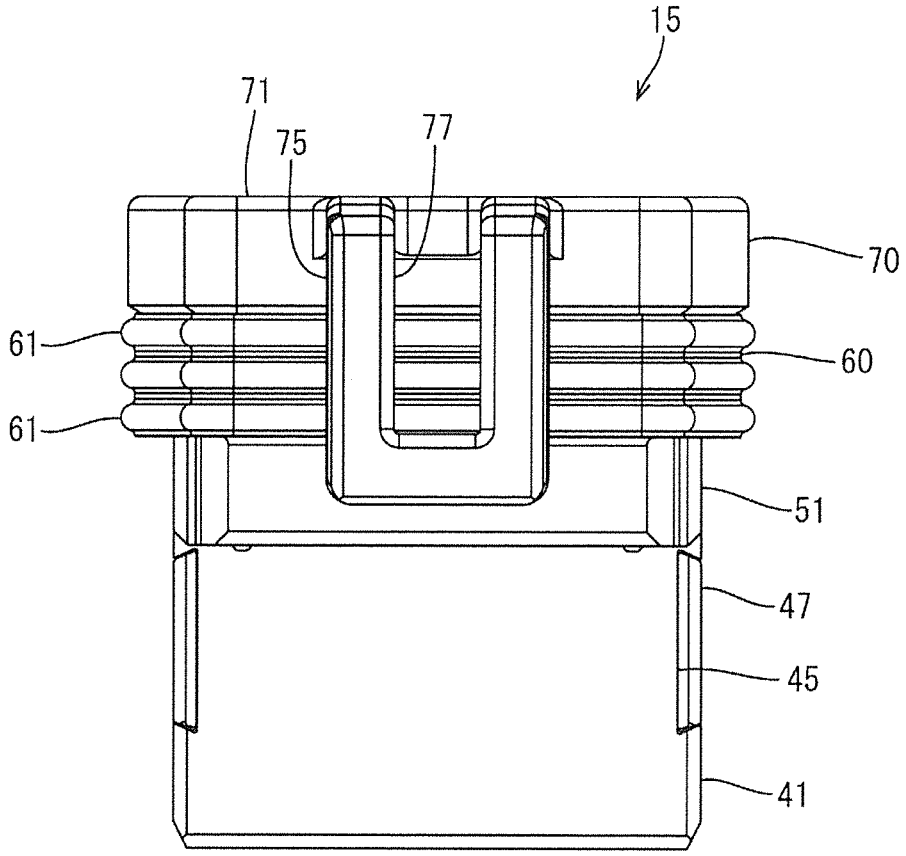
FIG. 8 is a plan view of the female connector.
Figure 16:
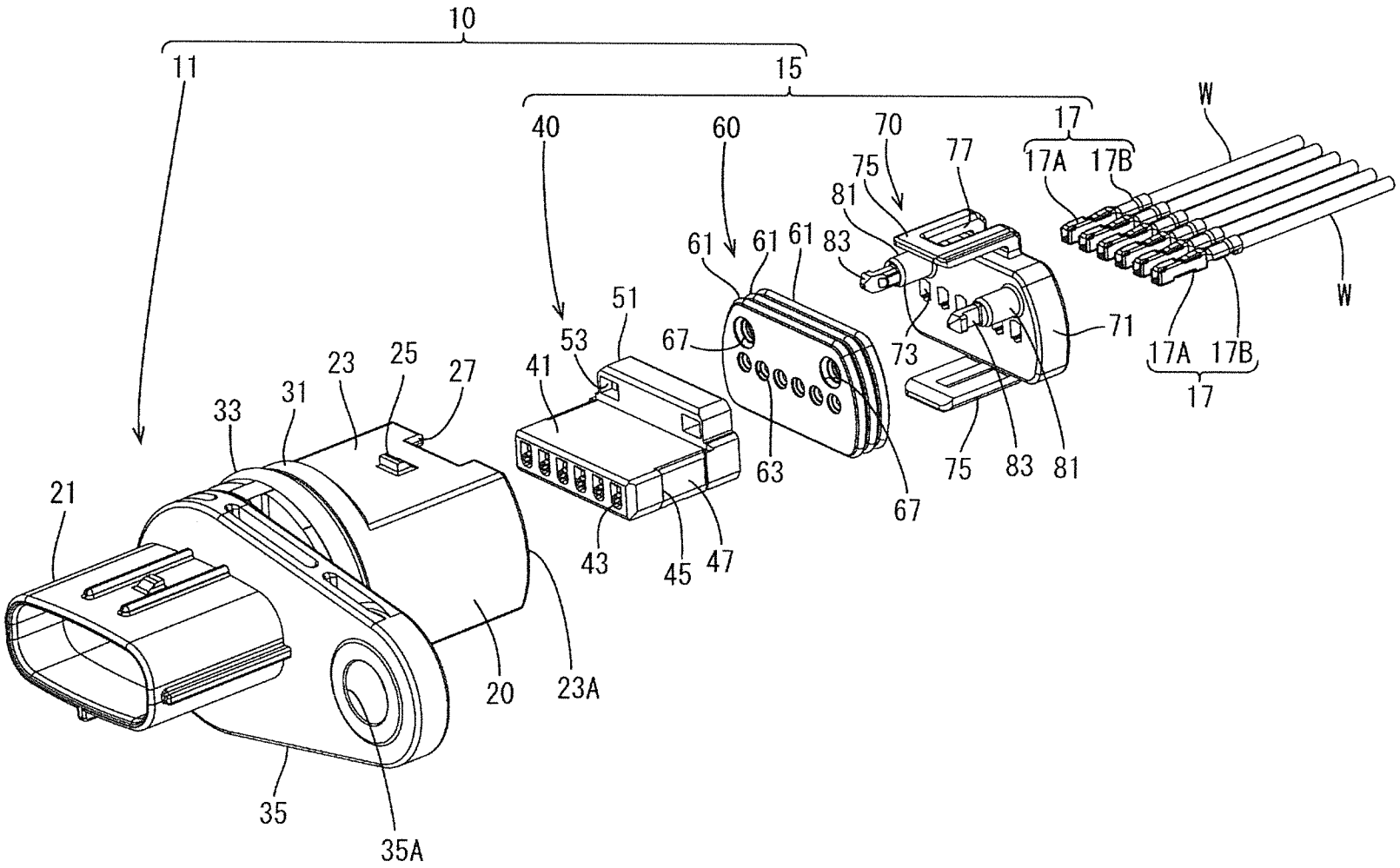
FIG. 16 is a perspective view of the connector in a state before the female connector is assembled.

As shown in FIGS. 5 and 7, the female connector 15 includes female terminal fittings 17 (an example of a "second terminal fitting", see FIG. 16), a female connector housing 40 (an example of a "second connector housing"), a one-piece rubber plug 60 (an example of a "rubber plug") and a rear holder 70 (an example of a "holder"). As shown in FIGS. 4 and 16, the female terminal fitting 17 is formed by press-working a conductive metal plate material and includes a connecting portion 17A in the form of a rectangular tube open in the front-rear direction, and a wire crimping portion 17B provided behind the connecting portion 17A. One end of the relay terminal fitting 13 is connected to the connecting portion 17A, and a wire W is connected to the wire crimping portion 17B.

Figure 10:
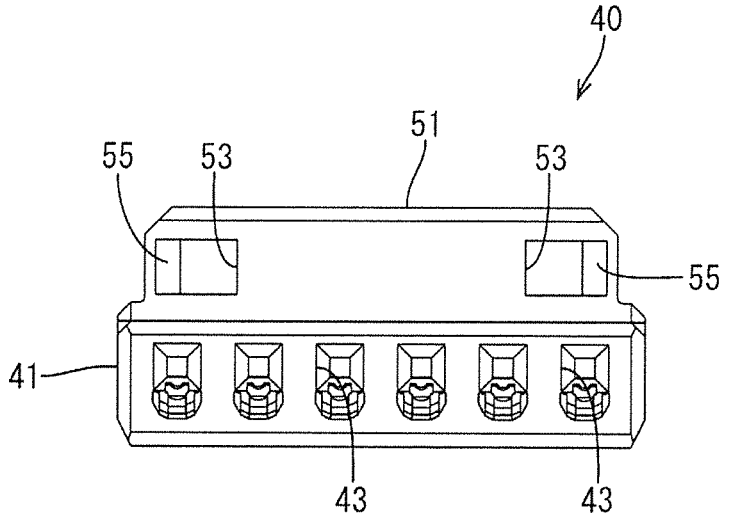
FIG. 10 is a front view of a female connector housing.
Figure 11:
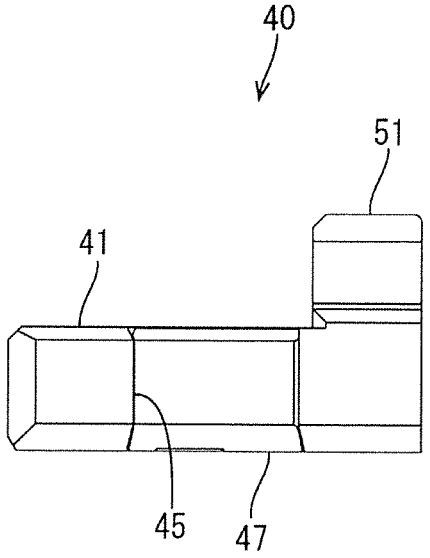
FIG. 11 is a side view of the female connector housing.

The female connector housing 40 is made of synthetic resin and includes, as shown in FIGS. 10 and 16, a housing body portion 41 and a housing engaging portion 51. As shown in FIGS. 4 and 16, the housing body portion 41 is in the form of a rectangular column long in a lateral direction, and a plurality of cavities 43 penetrating in the front-rear direction are provided side by side. The female terminal fittings 17 are insertable into the cavities 43 from behind. Further, a retainer mounting hole 45 is provided in the lower surface of the housing body portion 41 to communicate with the respective cavities 43. By mounting a retainer 47 into the retainer mounting hole 45, the female terminal fittings 17 accommodated in the cavities 43 are locked.

Figure 9:
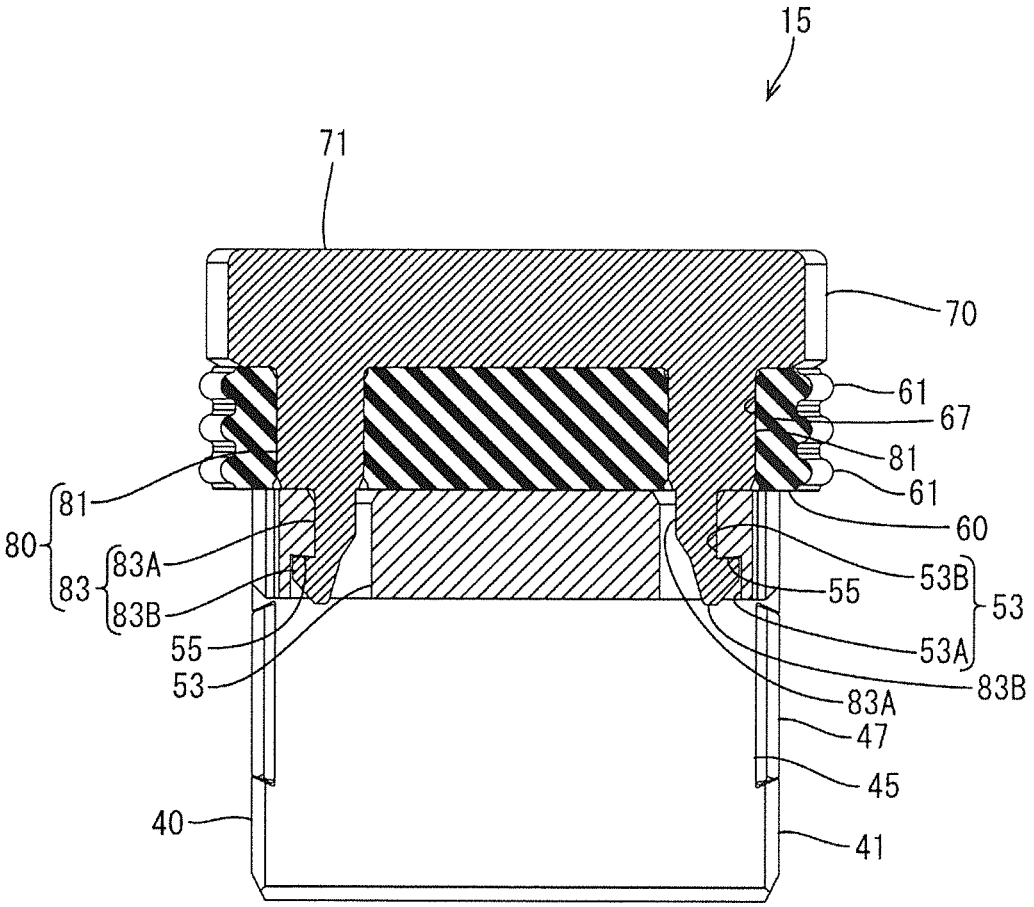
FIG. 9 is a section at position IX-IX in FIG. 5.

As shown in FIGS. 10 and 16, the housing engaging portion 51 is integrally provided to the housing body portion 41 and in the form of a laterally long rectangular tube projecting upward from a rear end part of the housing body portion 41. A vertical dimension of the housing engaging portion 51 is substantially equal to that of the housing body portion 41, and a dimension of the housing engaging portion 51 in the front-rear direction is about one fourth of that of the housing body portion 41. Engaging portions 53 having a rectangular cross-sectional shape penetrate through both end parts of the housing engaging portion 51 in the front-rear direction. A pair of the engaging portions 53 are provided in the both end parts of the housing engaging portion 51 in the width direction. Further, as shown in FIGS. 9 and 10, the engaging portion 53 is such that a front part 53A is larger than a rear part 53B on a widthwise outer side and the front end surface of the rear part 53B serves as a stepped surface 55.

Figure 12:
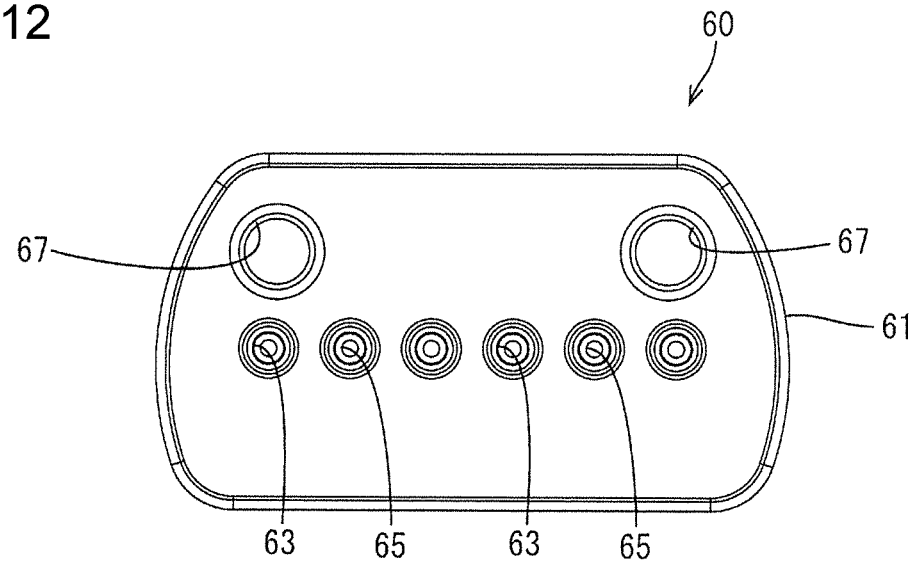
FIG. 12 is a front view of a one-piece rubber plug.

The one-piece rubber plug 60 is made of a resilient material such as oil resistant rubber and seals between a plurality of the wires W and the inner peripheral surface of the inner receptacle 23 as shown in FIGS. 4 and 12. The one-piece rubber plug 60 has an outer peripheral shape, which is the same as an inner peripheral shape of the opening 23A of the inner receptacle 23 and has an oval shape in a front view, and the vertical direction is a minor axis direction along which the one-piece rubber plug 60 is short. A plurality of outer peripheral lip portions 61 are provided on the outer peripheral surface of the one-piece rubber plug 60 and held in close contact with the inner receptacle 23 by being squeezed by the inner peripheral surface of the inner receptacle 23.

The one-piece rubber plug 60 is provided with a plurality of wire insertion holes 63 through which the wires W are to be inserted and which penetrate in the front-rear direction. A plurality of inner peripheral lip portions 65 are provided on the inner peripheral surface of the wire insertion hole 63. Further, the one-piece rubber plug 60 is provided with two insertion holes 67 for allowing the passage of projecting portions 80 to be described later. The insertion hole 67 has a circular cross-sectional shape, penetrates in the front-rear direction and has an inner diameter equal to an outer diameter of a projecting body portion 81 of the projecting portion 80 to be described later, and lips are provided on an inner peripheral surface to be held in close contact with the projecting body portion 81.

Figure 13:
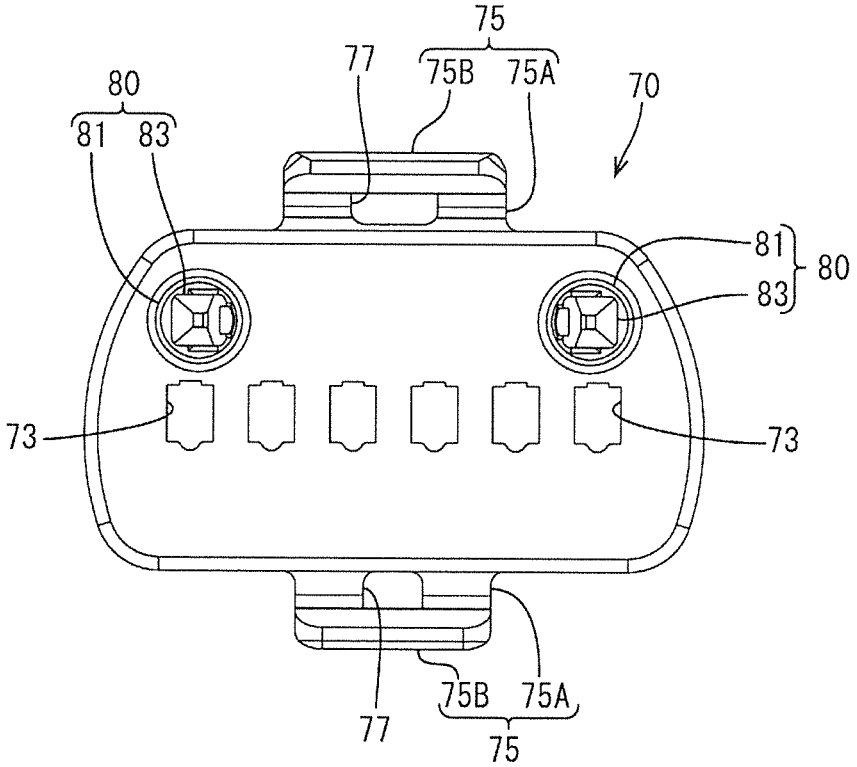
FIG. 13 is a front view of a rear holder.

The rear holder 70 is made of synthetic resin and includes, as shown in FIGS. 13 and 16, a holder body portion 71, lock arms 75 and the projecting portions 80. The holder body portion 71 is fit into the inner receptacle 23 and has the same outer shape as the one-piece rubber plug 60. Further, a dimension of the holder body portion 71 in the front-rear direction is equal to that of the one-piece rubber plug 60. Further, the holder body portion 71 is provided with terminal insertion holes 73 enabling the insertion of the female terminal fittings 17.

Figure 14:
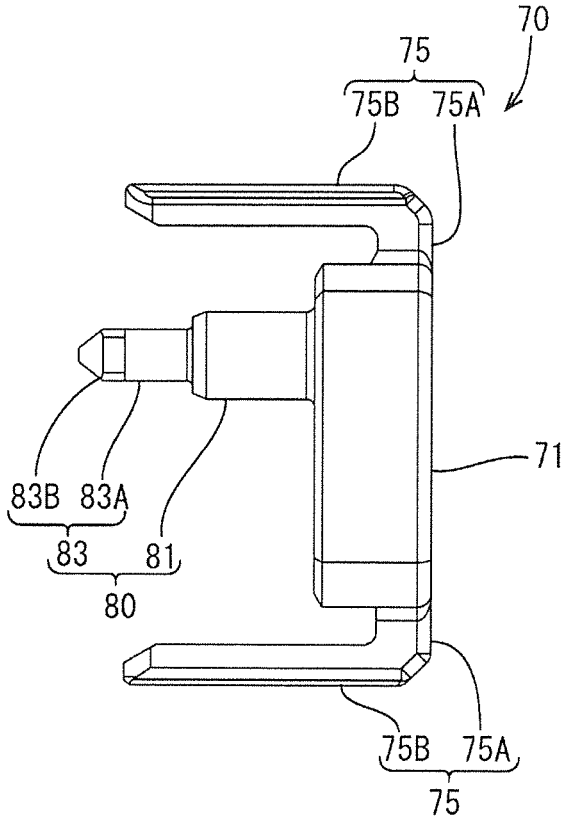
FIG. 14 is a side view of the rear holder.

As shown in FIGS. 3 and 14, the lock arm 75 includes a base end portion 75A vertically projecting from a rear end part of the holder body portion 71 and an arm portion 75B projecting forward from an upper/lower end part of the base end portion 75A. A dimension of the lock arm 75 in the width direction is substantially equal to an inner dimension of the cut portion 27 of the inner receptacle 23 in the width direction, and the base end portion 75A of the lock arm 75 is accommodated into the cut portion 27. Further, the arm portion 75B of the lock arm 75 overlaps on the upper/lower surface of the inner receptacle 23. An engaging hole 77 is provided in central parts of the base end portion 75A and the arm portion 75B. A front hole edge part 77A of this engaging hole 77 is locked to the engaging projection 25.

Figure 15:
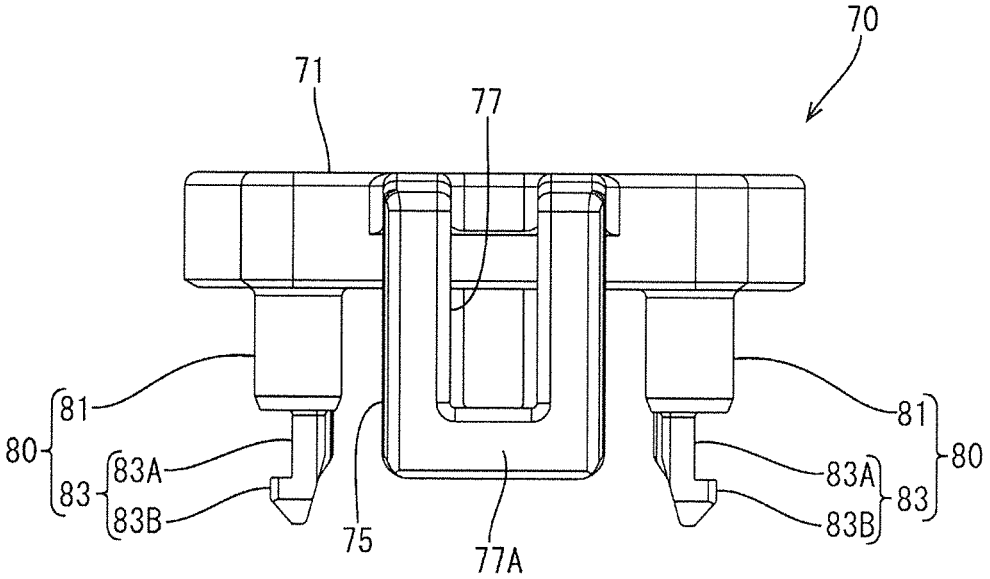
FIG. 15 is a plan view of the rear holder.

As shown in FIGS. 15 and 16, a pair of the projecting portions 80 project forward from the front surface of the holder body portion 71. The projecting portions 80 are provided on both widthwise end parts of an upper end part (above the terminal insertion holes 73) of the holder body portion 71. The projecting portion 80 includes the projecting body portion 81 and an engaging claw 83. The projecting body portion 81 has a cylindrical shape and a dimension of the projecting body portion 81 in the front-rear direction is equal to that of the one-piece rubber plug 60.

As shown in FIGS. 9 and 13, the engaging claw 83 projects forward from the front end surface of the projecting body portion 81 and includes a rectangular column part 83A and a claw portion 83B provided on a tip part of the rectangular column part 83A. The claw portion 83B projects outward in the width direction from the rectangular column part 83A. The rectangular column part 83A of the engaging claw 83 is thinner than the projecting body portion 81 and resiliently deformable. Further, a dimension of the rectangular column part 83A of the engaging claw 83 in the front-rear direction is substantially equal to that of the rear part 53B of the engaging portion 53 of the housing engaging portion 51, and a dimension of the claw portion 83B of the engaging claw 83 in the front-rear direction is substantially equal to that of the front part 53A of the engaging portion 53 of the housing engaging portion 51. The rear end surface of the claw portion 83B comes into contact with the stepped surface 55 in the engaging portion 53, whereby the engaging claw 83 is engaged with the engaging portion 53 of the female connector housing 40.

Next, an example of the procedure of assembling the connector 10 is described.

First, the relay connector 11 is assembled. As shown in FIGS. 4 and 16, the relay connector housing 20 is molded with the relay terminal fittings 13 embedded. The potting agent is injected into the recess 21A of the outer receptacle 21 and solidified. Further, the rubber ring 33 is mounted on the outer peripheral surface of the fitting portion 31.

On the other hand, the female connector 15 is assembled as shown in FIGS. 9 and 16. The one-piece rubber plug 60 is fixed to the rear holder 70 by inserting the projecting portions 80 of the rear holder 70 into the insertion holes 67 of the one-piece rubber plug 60. At this time, the outer peripheral surfaces of the projecting body portions 81 are held in close contact with the inner peripheral surfaces of the insertion holes 67. Then, the engaging claws 83 are inserted into the engaging portions 53 provided in the housing engaging portion 51. The claw portions 83B of the engaging claws 83 are caught by the stepped surfaces 55 of the engaging portions 53 to fix the rear holder 70 and the female connector housing 40.

Figure 17:
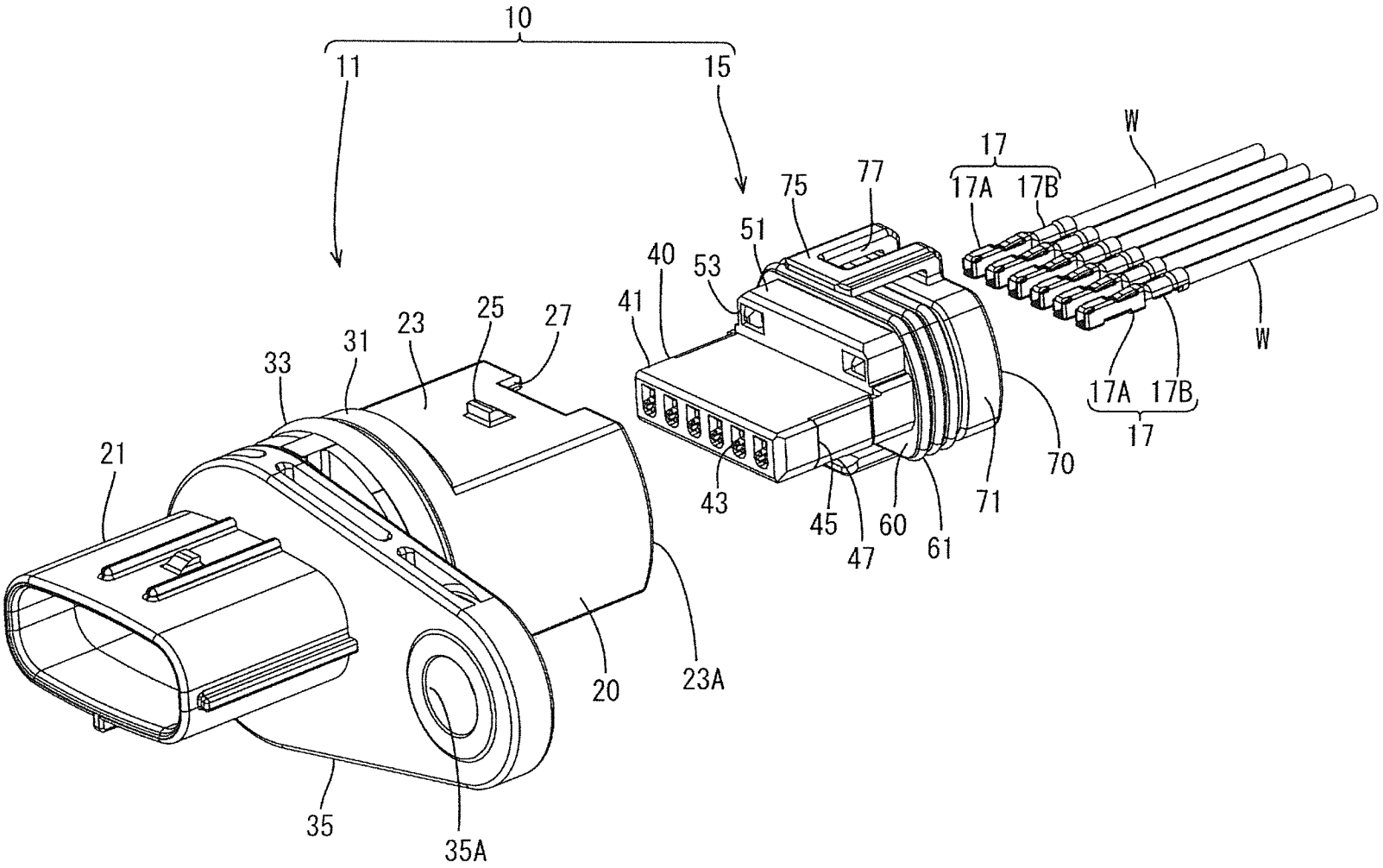
FIG. 17 is a perspective view of the connector while the female connector is being assembled.

Subsequently, as shown in FIGS. 4 and 17, the female terminal fittings 17 are inserted into the female connector housing 40. First, the wire crimping portions 17B of the female terminal fittings 17 are crimped and connected to the wires W. Then, the female terminal fittings 17 are inserted into the terminal insertion holes 73 from behind the rear holder 70. At this time, since the holder body portion 71 of the rear holder 70 has about the same dimension in the front-rear direction as the one-piece rubber plug 60, the female terminal fittings 17 contact the inner peripheral surfaces of the terminal insertion holes 73 while being inserted into the terminal insertion holes 73, whereby the female terminal fittings 17 are positioned.

Then, the positioned female terminal fittings 17 are inserted through the wire insertion holes 63 of the one-piece rubber plug 60. At this time, since the female terminal fittings 17 are positioned, the female terminal fittings 17 can be inserted in a proper posture into the wire insertion holes 63 of the one-piece rubber plug 60 to suppress the damage of the inner peripheral surfaces of the wire insertion holes 63. Then, the female terminal fittings 17 inserted through the wire insertion holes 63 are inserted into the cavities 43 of the female connector housing 40. Then, the retainer 47 is mounted to lock the female terminal fittings 17. When the female terminal fitting 17 is inserted to a proper position in the cavity 43, the inner peripheral lip portions 65 of the wire insertion hole 63 are held in close contact with the outer peripheral surface of the wire W.

Figure 18:
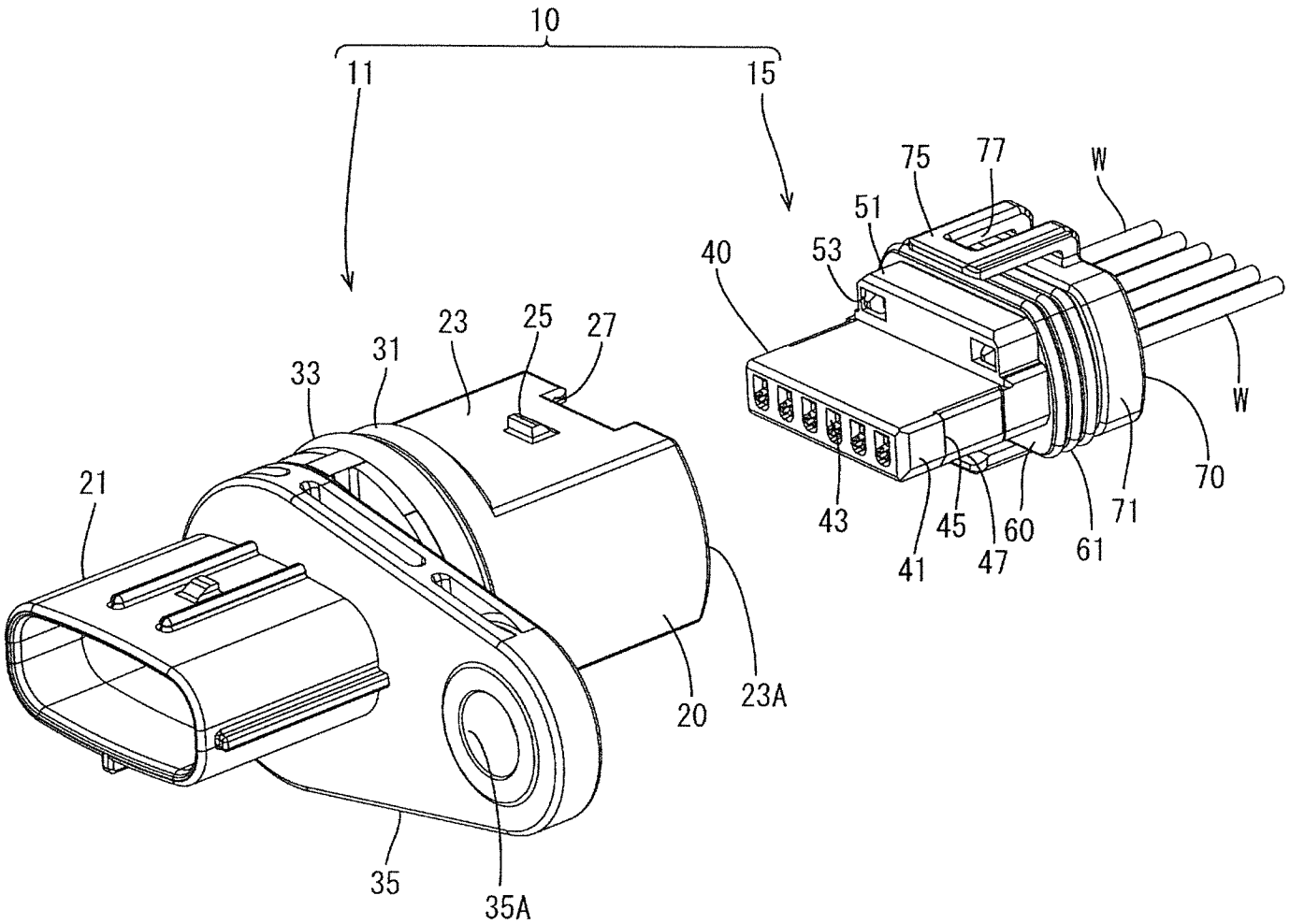
FIG. 18 is a perspective view of the connector in a state where the female connector is assembled.

Then, as shown in FIGS. 4 and 18, the female connector 15 is connected to the relay connector 11. The female connector 15 is inserted into the opening 23A of the inner receptacle 23 from behind and pushed to a position where the front end surface of the housing engaging portion 51 of the female connector housing 40 butts against the inner surface of the inner receptacle 23. At this time, the lock arms 75 of the rear holder 70 are resiliently deformed to be wider apart in the vertical direction, move beyond the engaging projections 25 and are restored. Then, the engaging projections 25 are fit into the engaging holes 77 of the lock arms 75.

When the female connector 15 and the relay connector 11 are connected at a proper position, the female terminal fittings 17 and the relay terminal fittings 13 are connected. Further, the outer peripheral lip portions 61 of the one-piece rubber plug 60 are held in close contact with the inner peripheral surface of the inner receptacle 23. Then, the holder body portion 71 of the rear holder 70 is fit into the inner receptacle 23, and the female connector 15 is retained in the relay connector 11 because the lock arms 75 are locked to the engaging projections 25.

Then, the relay connector 11 having the female connector 15 connected thereto is mounted on the case C of the device. The rear side (side where the female connector 15 is connected) of the relay connector 11 is inserted into the mounting hole C1 of the case C, the fitting portion 31 is fit into the mounting hole C1 and the rubber ring 33 is held in close contact with the inner peripheral surface of the mounting hole C1 for sealing. Note that the female connector 15 is provided with no receptacle and the lock arms 75 are engaged with the engaging projections 25 projecting on minor axis sides of the inner receptacle 23. Thus, parts (inner receptacle 23 and female connector 15) to be inserted into the mounting hole C1 can have small outer dimensions and an inner diameter of the mounting hole C1 can be reduced.

As described above, in this embodiment, the female connector 15 is integrated by inserting the projecting body portions 81 of the projecting portions 80 of the rear holder 70 into the insertion holes 67 of the one-piece rubber plug 60 and engaging the engaging claws 83 of the projecting portions 80 with the engaging portions 53 of the female connector housing 40. That is, the female connector 15 can be connected to the relay connector 11 with the female connector housing 40, the one-piece rubber plug 60 and the rear holder 70 of the female connector 15 assembled in advance, and an operation is easier as compared to the case where these components are separately arranged in the receptacle.

When the female connector 15 is connected to the relay connector 11, the female connector housing 40 of the female connector 15 is accommodated into the inner receptacle 23 of the relay connector 11, a rear side of the female connector housing 40 is sealed by the one-piece rubber plug 60, and the female connector housing 40 and the one-piece rubber plug 60 are retained by the rear holder 70. Thus, the intrusion of foreign matters into the female connector housing 40 in the inner receptacle 23 can be prevented by the one-piece rubber plug 60, wherefore a short circuit between the terminal fittings 13 and 17 can be prevented.

Further, the lock arms 75 of the rear holder 70 are engaged with the engaging projections 25 provided to project in the minor axis direction (vertical direction) on the outer surface of the inner receptacle 23 having an oval shape in a back view. Thus, the lock arms 75 overlap on the inner receptacle 23, thereby being able to suppress an increase of an outer diameter. Further, since the rear holder 70 is mounted by engaging the lock arms 75 of the rear holder 70 with the engaging projections 25 projecting on the outer surface of the inner receptacle 23, no locking hole is provided in the inner receptacle 23 of the relay connector 11 and sealing by the one-piece rubber plug 60 is easily ensured. Furthermore, since no receptacle is overlapped on the receptacle unlike general waterproof connectors, enlargement in the width direction (radial direction) can be suppressed.

The invention is not limited to the above described and illustrated embodiment. For example, the following embodiments are also included in a technical scope.

Although the relay connector 11 is a connector for relaying two connectors by being mounted on the case C of the device in the above embodiment, it may be a general connector to be mounted on an end of a wiring harness or the like.

Although the relay terminals 13, which are male terminals, are accommodated in the relay connector 11 and the female terminal fittings 17 are accommodated in the female connector 15 in the above embodiment, female terminal fittings may be accommodated in a relay connector.

Although the rear holder body portion 71 of the rear holder 70 is fit into the inner receptacle 23 while having a plate thickness substantially equal to that of the one-piece rubber plug 60 in the above embodiment, a holder body portion may be in the form of a thin plate and disposed to cover the outside of an inner receptacle.

Although the one-piece rubber plug 60 collectively seals between the plurality of wires W connected to the plurality of female terminal fittings 17 and the inner receptacle 23 in the above embodiment, one terminal fitting may be provided and a rubber plug may seal between one wire W and the inner receptacle 23.

Although the stepped surfaces 55 are provided in the engaging portions 53 of the female connector housing 40 and the engaging claws 83 of the projecting portions 80 are engaged therewith in the above embodiment, the engaging claws 83 may be engaged with hole edges of the engaging portions 53 without providing any step. Although the rear holder 70, the one-piece rubber plug 60 and the female connector housing 40 are integrated by inserting the projecting portions 80 of the rear holder 70 into the insertion holes of the one-piece rubber plug 60 and engaging the engaging claws 83 of the projecting portions 80 with the engaging portions 53 of the female connector housing 40 and are fit into the relay connector 11 in the above embodiment, these components may be separately fit into the relay connector 11.

LIST OF REFERENCE SIGNS

10 . . . connector
11 . . . relay connector (first connector)
13 . . . relay terminal fitting (first terminal fitting)
15 . . . female connector (second connector)
17 . . . female terminal fitting (second terminal fitting)
20 . . . relay connector housing (first connector housing)
23 . . . inner receptacle (receptacle)
23A . . . opening
23B . . . both side surfaces
23C . . . upper/lower surface
25 . . . engaging projection
31 . . . fitting portion
31A . . . fitting recess
40 . . . female connector housing (second connector housing)
41 . . . housing body portion
51 . . . housing engaging portion

53 . . . engaging portion
55 . . . stepped surface
60 . . . one-piece rubber plug (rubber plug)
61 . . . outer peripheral lip portion
63 . . . wire insertion hole
65 . . . inner peripheral lip portion
67 . . . insertion hole
70 . . . rear holder (holder)
71 . . . holder body portion
73 . . . terminal insertion hole
75 . . . lock arm
77 . . . engaging hole
80 . . . projecting portion
81 . . . projecting body portion
83 . . . engaging claw
C . . . case
W . . . wire

The invention claimed is:

1. A connector, comprising:

a first connector including a first connector housing provided with a receptacle having an opening on one end and configured to accommodate first terminal fittings on a back end of the receptacle; and a second connector to be connected to the first connector; wherein:

the second connector includes:

a second connector housing including cavities provided side by side and configured to be accommodated into the receptacle;

second terminal fittings to be accommodated respectively into the cavities, the second terminal fittings being connectable respectively to the first terminal fittings and having wires connected thereto;

a rubber plug configured to seal between outer peripheral surfaces of the wires and an inner peripheral surface of the receptacle on a rear side of the second connector housing; and a holder configured to retain the second connector housing and the rubber plug in the receptacle by being engaged with an engaging projection provided on an outer surface of the first connector housing and mounted on the receptacle;

the holder is provided with a projecting portion projecting toward the second connector housing and terminal insertion holes enabling insertion of the second terminal fittings respectively;

the rubber plug is provided with an insertion hole enabling insertion of the projecting portion therethrough;

the second connector housing is provided with an engaging portion engageable with an engaging claw provided on a tip part of the projecting portion;

the engaging portion is located inwardly of the cavity located at an outermost position;

the first connector housing includes a cylindrical fitting to be fit into a mounting hole provided in a device;

the receptacle is insertable into the mounting hole and has an oval cross-section;

the engaging projection projects in a minor axis direction of the receptacle;

the holder of the second connector is provided with a lock arm having an engaging hole engageable with the engaging projection;

the lock arm includes a base end portion projecting from the holder in a direction perpendicular to an arrangement direction of the terminal insertion holes and an arm projecting from a projecting end part of the base end portion toward the second connector housing;

a cut provided in an opening end part of the receptacle and recessed toward the engaging projection; and the base end portion of the lock arm is accommodated in the cut.

2. The connector of claim 1, wherein:

the holder is provided with a projecting portion projecting toward the second connector housing;

the rubber plug is provided with an insertion hole enabling the insertion of the projecting portion; and the second connector housing is provided with an engaging portion engageable with an engaging claw provided on a tip part of the projecting portion.

3. The connector of claim 1, wherein:

the second connector housing includes a housing body provided with the cavities and a housing engaging portion projecting up from a rear end part of the housing body; and two of the engaging portions penetrate in a front-rear direction on both end parts of the housing engaging portion.

* * * * *